United States Patent [19]

Major, Jr., deceased et al.

[11] 4,447,107

[45] May 8, 1984

[54] COLLET FOR CABLE CONNECTOR

[76] Inventors: Frederick A. Major, Jr., deceased, late of Tempe, Ariz.; by Clare M. Major, personal representative, 175 E. Ellis Dr., Tempe, Ariz. 85282

[21] Appl. No.: 361,732

[22] Filed: Mar. 25, 1982

[51] Int. Cl.[3] ..... H01R 17/18

[52] U.S. Cl. ..... 339/171 E; 339/89 C

[58] Field of Search ..... 24/136 R; 339/60 R, 339/60 C, 89 C, 90 C, 107, 149 R, 200 R, 201, 177 R, 177 E

[56] References Cited

U.S. PATENT DOCUMENTS 3,847,463 11/1974 Hayward et al. ..... 339/177 R

*Primary Examiner*—Eugene F. Desmond
*Assistant Examiner*—Steven C. Bishop
*Attorney, Agent, or Firm*—H. Gordon Shields

[57] ABSTRACT

Collet apparatus for a cable connector includes a cylindrical bore through which a length of conductor extends with longitudinally extending gripper fingers on one end of the bore which are cammed inwardly to grip the cable and with a counterbore remote from the fingers to provide an air dielectric for the cable.

2 Claims, 8 Drawing Figures

COLLET FOR CABLE CONNECTOR

BACKGROUND OF THE INVENTION

1. Field of the Invention

This invention relates to connectors and, more particularly, to coaxial cable connectors having a collet which grips a cable end for connecting two lengths of cable together.

2. Description of the Prior Art

In a cable connector, used for joining together two lengths of coaxial cable, the connector includes a mating collet and a collet closure. The collet grips the cable and extends into the collet closure for camming the collet against the cable, thus securing the cable within the connector. The collets of the prior art generally include outwardly extending cam portions having cam surfaces which mate with the collet closure to cam the collet against the cable when a force is applied along the collet, as from a nut, or the like, disposed outside and about the collet. The prior art collets include a bore having a uniform diameter throughout the length of the collet. The exterior of the collet is of an irregular configuration in that it extends outwardly and then tapers inwardly to define the cam portion.

Two problems have generally been recognized with the collets of the prior art. One problem is the dielectric or insulative properties of the collet and the second is the strength of the collet in gripping the wire cable to be connected. The apparatus of the present invention overcomes both problems. There is a third problem with the prior art, namely the cost of manufacturing the collets. Prior art collets require screw machines. The apparatus of the present invention lends itself well to molding techniques, as opposed to requiring screw machines for prior art collets.

SUMMARY OF THE INVENTION

The apparatus disclosed and claimed herein comprises a collet for a cable connector having a base flange and a cylindrical portion connected to the base flange and an inward taper on one end of the cylindrical portion remote from the base flange, a bore extending through the cylindrical portion, and a counterbore extending through the base flange and into the cylindrical portion communicating with the bore, and the cylindrical portion providing straight line, pillar type strength for gripping a cable.

Among the objects of the present invention are the following:

To provide new and useful cable connector apparatus;

To provide new and useful collet for a cable connector;

To provide a new and useful collet having a bore through which a cable extends and a counterbore about a portion of the cable for air dielectric purposes; and To provide new and useful collet apparatus for a cable connector capable of being manufactured by molding techniques.

DESCRIPTION OF THE PREFERRED EMBODIMENT

Figure 1:
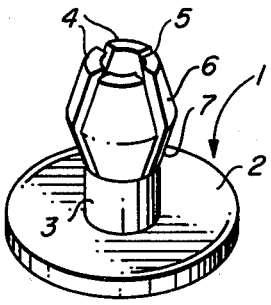
FIG. 1 (PRIOR ART)
FIG. 1 is a perspective view of a collet of the prior art.
Figure 2:
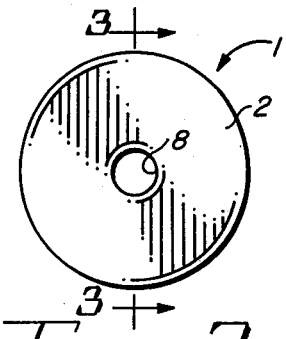
FIG. 2 (PRIOR ART)
FIG. 2 is an end view of the collet of FIG. 1.
Figure 3:
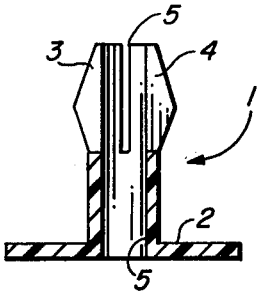
FIG. 3 (PRIOR ART)
FIG. 3 is a view in partial section of the collet of FIG. 2, taken generally along line 3—3 of FIG. 2.

FIGS. 1, 2, and 3 are various views of a prior art collet 1. FIG. 1 is a perspective view of prior art collet 1, FIG. 2 is an end view of the prior art collet 1, and FIG. 3 is a view in partial section of the prior art collet 1, taken generally along line 3—3 of FIG. 2.

The prior art collet 1 includes a base flange 2 which is generally circular in configuration. The base flange 2 is comparable to a disc with a column or cylinder 3 extending from one of the flat surfaces of the disc. Extending from the cylinder 4 are a plurality, namely four, of fingers 4. The fingers 4 are defined by four slots 5.

The exterior of the fingers is a curved, convex surface. For the convex configuration, the curve includes a cam surface 6 and a taper 7. The taper extends outwardly from the cylinder 3 and the cam surface extends inwardly from the maximum diameter of the outward taper inwardly towards the front end of the fingers.

Extending longitudinally through the prior art collet is a bore 8 of uniform diameter. The term "uniform" refers generally to the diameter of the bore, and does not, of course, include the longitudinally extending slots 5 between the fingers.

Figure 5:
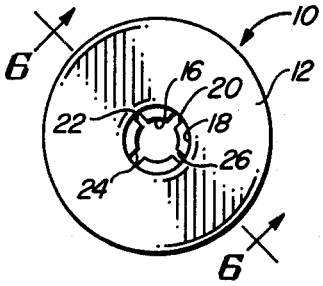
FIG. 5 is an end view of the collet apparatus of FIG. 4.
Figure 4:
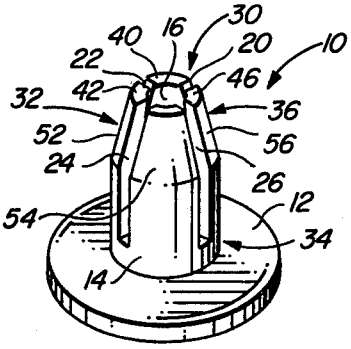
FIG. 4 is a perspective view of the collet apparatus of the present invention.
Figure 6:
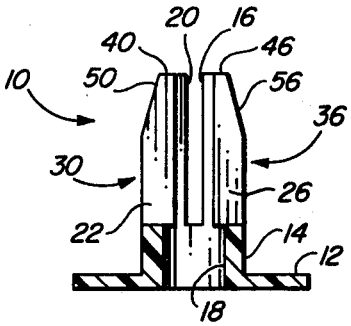
FIG. 6 is a view in partial section of the collet apparatus of FIG. 5, taken generally along line 6—6 of FIG. 5.
Figure 7:
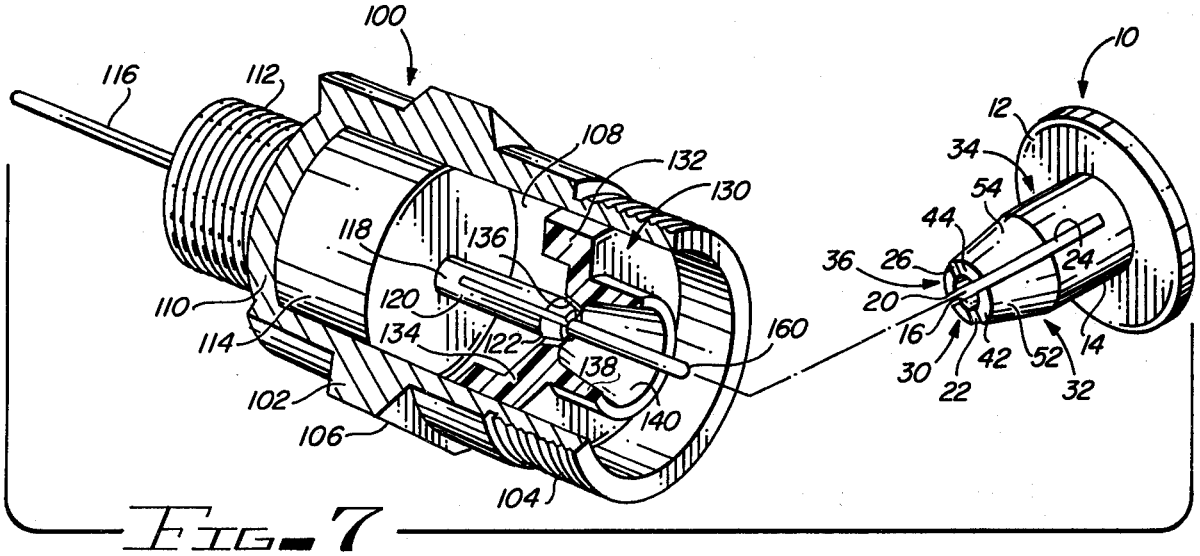
FIG. 7 is a perspective view in partial section of a cable connector illustrating the use of the apparatus of the present invention.
Figure 8:
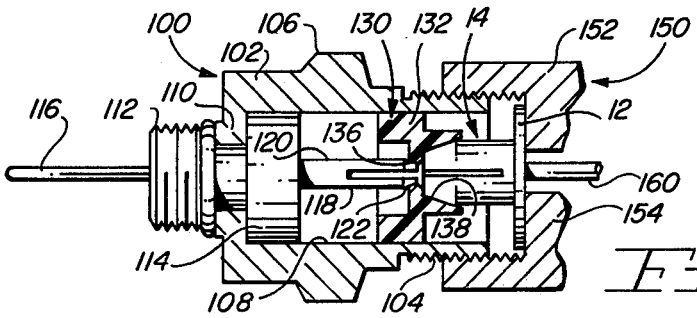
FIG. 8 is a view in partial section of the cable connector of FIG. 7 with the collet apparatus of the present invention in place illustrating its use.

FIG. 4 is a perspective view of a collet 10 of the present invention. FIG. 5 is an end view of the collet 10 of FIG. 4. FIG. 6 is a view in partial section of the collet 10 taken generally along line 6—6 of FIG. 5. FIG. 7 is a perspective view of the collet apparatus 10 shown spaced apart from the coaxial cable connector with which the collet 10 is used. The cable connector is shown in partial section for convenience in illustrating the collet of the present invention. FIG. 8 is a view in partial section of the cable connector in its use environment, with the collet in place within the connector. For the following discussion, reference will primarily be made to FIGS. 4, 5, 6, 7, and 8.

The collet 10 includes a circular base flange 12 with a cylinder 14 extending upwardly from the base flange 12 substantially perpendicular to the flange and generally centered on the flange. The flange 12 is a circular disc, and the cylinder 14 extends upwardly from the flat side of the disc.

Extending through the base flange 12 and the cylinder 14 is a bore 16. The bore 16 includes a counterbore 18. The counterbore 18 is of a slightly greater diameter than the bore 16. The counterbore 18 extends from the flange 12 inwardly a distance of about one-third of the overall length of the collet 10.

Four longitudinally extending slots extend from the counterbore through the cylinder 14. The slots include a slot 20, a slot 22, a slot 24, and a slot 26. The slots are spaced apart equally. The slots 20 and 24 are opposite each other, and the slots 22 and 26 are opposite each other, thus dividing the cylinder 14 into four equal and longitudinally extending fingers 30, 32, 34, and 36. The fingers 30 . . . 36 extend outwardly from the counterbore 18 and terminate remotely from the base flange 12 in four tips 40, 42, 44, and 46, respectively. The longitudinal bore 16 defines the common interior surface for each of the fingers 30 . . . 36. The tips 40 . . . 46 are generally flat, and are accordingly in a common plane substantially perpendicular to the longitudinal axis of the bores 16 and 18 and generally parallel to the flat surfaces of the base flange 12.

Each of the fingers 30 . . . 36 includes a tapered portion which extends outwardly from the outer surface of their tips. The tapered surfaces include tapers 50, 52, 54, and 56, respectively, for the fingers 30, 32, 34, and 36. The configuration of each taper is that of a portion of a conical surface with a minimum radius at the tips and a maximum radius equal to the radius of the cylinder 14 outwardly from the bore 16. The overall taper accordingly extends outwardly from the tip 46 to the exterior of the cylinder 14. Rephrased, the taper extends inwardly from the outer surface of the column or cylinder 14 at the distal portions of the fingers 36, remote from the column or cylinder 14, to a minimum dimension at the outer tips 40 . . . 46 of the fingers.

It will be noted, as best shown in FIG. 6, that the fingers 30 . . . 36 comprise a continuation of the column 14 with respect to the outer surface thereof from the base 12 to the tapered portions of the fingers. This provides a columnar effect with respect to the strength of each finger. The columnar strength of each finger is important to the use of the apparatus when a cable is gripped by the inner portions, namely the bore 16 portions, of the fingers 30 . . . 36, which is best shown in FIG. 8.

The tapered portions 50 . . . 56 of the fingers comprise cam surfaces for camming the fingers inwardly to grip a cable. The camming effect results from contact between the tapered portions 50 . . . 56 of the collet 10 and an inner conical surface 140 of a collet closure element 130. This is best shown in FIGS. 7 and 8.

A coaxial cable connector 100 is shown in partial section in both FIGS. 7 and 8, with the connector 100 shown in perspective in FIG. 7 spaced apart from the collet 10. The collet is also shown in perspective in FIG. 7. In FIG. 8, the collet 10 is shown assembled to the coaxial cable connector 100 and held in place by a connector cap 150.

The cable connector 100 includes a generally cylindrical body 102 having external threads 104 at one end. The external threads 104 are connected to the internal threads of the cap 150 to secure the connector and cap together. Disposed about the body are a plurality of wrench flats 106 which receive the jaws of a wrench to secure the cap 150 and the connector 100 together.

Within the body 102 is an interior bore 108. The interior bore 108 is closed at one end by an end wall 110. The opposite end of the bore 108 is opened to receive the collet 10 and a collet closure 130. Extending outwardly from the end wall 110 is an externally threaded connector boss 112. The diameter of the threaded connector boss 112 is substantially less than the diameter of the cylindrical body 102, including the bore portion with its external threads 104.

An insulator element 114 is disposed within the bore 108 and secured to the end wall 110. The insulator element 114 extends through an appropriate aperture or hole within the end wall 110 and through the connector boss 112 to insure electrical insulation between a conductor pin 116 and a conductor 160 which the collet 10 secures in place within the coaxial cable connector 100 and the cylindrical body 102. As is well known and understood, in coaxial cable there is a center or central conductive element, such as the cable 160, and an insulator is disposed about the central conductive element to electrically insulate the center conductor from an outer ground conductor. The outer, ground conductor is usually a metal mesh which covers the insulation material. An outer insulation layer covers the metal mesh. The metal mesh is electrically connected to the metal body 102 of the connector 100. Thus, the conductor pin 116 and the cable 160 must be electrically isolated, or insulated, from the body 102. The outer insulation layer, metal mesh, and an outer covering, all of which are typical and well known in the coaxial cable art, are not shown in the drawing. As indicated, only the cable 160, which is the central element in a coaxial cable, is shown in the drawing.

The conductor pin 116 extends outwardly or exteriorly of the cable connector 100 for appropriately securing it to a mating element (not shown). The mating element is secured in a use environment to the connector 100 at the threaded connector boss 112.

The exterior conductor pin 116 includes an internal coaxial conductor portion 118. The internal conductor 118 is of a somewhat cylindrical configuration that includes several, usually four, segments or fingers 120 into which the end of the conductor 160 extends. Electrical connection between the conductor 160 is made by the segments or fingers 120 of the internal coaxial conductor 118.

The outer ends of the segments or fingers 120, remote from the insulator 114, include inwardly tapered portions 122. The tapered portions 122 act as cam surfaces to cam the fingers 120 axially inwardly. The inward camming of the fingers 120 results in the coaxial contact between the fingers 120, and thus the conductor 118, and the cable 160. The tapered portions 122 mate with a central conically tapered aperture 136 of the collet closure element 130 to accomplish the camming action.

The collet closure element 130 is made of non-conductive material. It is disposed within the bore 108 of the connector 100. It includes an outer cylindrical portion 132 which is slightly less in its outer diameter than the inner diameter of the bore 108. The element 130 accordingly moves relatively freely within the bore 108. Extending inwardly from the cylindrical portion 132 is a web 134. The conically tapered aperture 136 is centrally disposed with the web 134. The tapered aperture 136 mates with the tapered portions 122 of the segments or fingers 120 to insure electrical contact between the segments or fingers 120 and the conductor 160 by cam action. It will be noted that the purpose of the electrical connection between the segments 120 and the conductor 160 is to insure a good electrical connection between the elements, and not to hold the cable 160 in place with respect to the connector 100.

The collet closure element 130 also includes, in addition to the outer cylindrical portion 132, an inner cylindrical portion 138. The inner cylindrical portion 138 is of a lesser diameter than the outer cylindrical portion 132. It extends outwardly from the web 134 in the opposite direction from the outer cylindrical portion 132. Within the inner cylindrical portion 138 is a conically tapered bore 140. The conically tapered bore 140 tapers outwardly, away from the tapered aperture 136, and accordingly has its widest or greatest diameter remote from the aperture 136. The tapers of the aperture 136 and the bore 140 extend in opposite directions, with the narrowest portion, or throat, at the center, as in a venturi. The conically tapered bore 140 mates with the conically tapered portions 50, 52, 54, and 56 of the collet 10 to urge the fingers 30, 32, 34, and 36 into engagement with the conductor 160. Thus, the fingers 30 . . . 36 of the collet 10 hold the conductor 160 in place with respect to the coaxial cable connector 100.

It will be noted that the terms "conically tapered aperture" and "conically tapered bore" refer to substantially the same types of configurations on or in the collet closure 130. They differ from each other only in size or degree due to the difference in their mating elements and in the functions of their mating elements. The camming concept is the same with both mating elements, but the sizes differ due to the functional differences. On the one hand, electrical contact is the function, and on the other hand, physical holding contact is the function.

The cap 150 includes an internally threaded cylindrical body portion 152 which receives or mates with the externally threaded portion 104 of the conector 100. For purposes of mating with the flange 12 of the collet 10, the cap 150 includes an apertured end wall 154. As the threaded connection between the cap 150 and the connector 100 is made, the end wall 154 bears against the flange 12 and urges the collet and the collet closure together. The mating of the conically tapered bore 140 of the collet closure 130 and of the mating conically tapered portions 50 . . . 56 of the fingers 30 . . . 36 results in a camming action which moves the fingers 30 . . . 36 inwardly to securely grip and hold the conductor 160. The conductor 160 is accordingly secured to the connector 100.

The longitudinally axial movement of the collet 10 also results in the longitudinally axial movement of the collet closure 130 in the bore 108. This movement causes a cooperating camming action between the tapered aperture 136 of the collet closure 130 and the taper 122 of the fingers or segments 120 to insure electrical contact between the conductor 160 and the segments or fingers 120. The double camming thus accomplishes the purposes of both holding the conductor 160 by the collet 110 and of insuring electrical connection between the conductor 160 and the conductive portions of the cable connector 100, namely the segments or fingers 120, the internal conductor 118, and the external end or pin portion 116.

Returning again to FIG. 6, and also to FIGS. 7 and 8, it will be noted that it is the longitudinal portion of the fingers 30 . . . 36, namely the interior portion of the fingers, which defines the central bore 16 which contact the conductor 160. The counterbore 18 is disposed concentrically about the cable or conductor 160. The counterbore thus puts additional air, which is the best dielectric, around the cable or conductor 160. This aids in insuring that the cable or conductor 160 is adequately insulated from the connector shell or body 102 and also from the cap 150.

The end wall 154 bears directly against the base flange 12, and the force or stress from the end wall 154 through the flange 12 is transmitted directly to the cylinder 14 in an axial or columnar manner and to the fingers 30 . . . 36 to securely grip the cable or conecutor 160. In addition, the columnar stress in the collet 10 is directly inwardly to grip and thus fasten the conductor or cable 160 without the stresses imposed by the prior art. This configuration of the columnar stresses prevents cracking in the area of the fingers which characterizes the prior art.

The collet 10 is, naturally, made of insulative material. Also made of insulative, nonconductive material is the insulator 114 and the insulator element 132. Since air is a very good insulator, and accordingly has higher dielectric properties than most other insulators, it is highly desirable to have as much air about the cable 160, and its related conductive components, namely the pin 114 and the conductive elements 118 and 120, as is reasonably possible. At the same time, however, it is obvious that the cable 116 must be grasped securely and held within the connector 100 and that there must be good electrical connection made between the cable 160 and its mating elements, the fingers 120 of the conductor or connective element 118.

What is claimed is:

1. Collet apparatus for a coaxial cable connector, comprising, in combination:

a base flange;

a column extending downwardly from the base flange;

a plurality of fingers extending outwardly from the column and comprising a continuation of the column and adapted for gripping a cable to be connected;

a plurality of axially extending slots disposed between the fingers;

a bore extending longitudinally of the fingers and defining the interior surfaces of the fingers for gripping the cable;

a counterbore extending through the flange and the column and communicating with the bore through which the cable extends; and conically tapered surfaces on the exterior of the fingers remote from the column defining cam surfaces for camming the fingers radially inwardly to grip the cable, and the column and the fingers between the base flange and the conically tapered cam surfaces are straight and generally cylindrical in configuration.

2. The apparatus of claim 1 in which slots extend axially outwardly from the counterbore and radially outwardly from the longitudinally extending bore.

* * * * *